US005857297A

United States Patent [19]

Sawyer

[11] Patent Number: 5,857,297

[45] Date of Patent: Jan. 12, 1999

[54] FOUNDATION WALL CONSTRUCTION

[76] Inventor: Robert D. Sawyer, 6365 S. 20th St., Oak Creek, Wis. 53154

[21] Appl. No.: 879,179

[22] Filed: Jun. 20, 1997

[51] Int. Cl.[6] ..... F02D 19/12; F02B 11/00

[52] U.S. Cl. ..... 52/169.5; 52/169.14; 405/43; 405/45

[58] Field of Search ..... 52/169.5, 169.14; 405/43, 45

[56] References Cited

U.S. PATENT DOCUMENTS

| | | | |
|---|---|---|---|
| 3,318,056 | 5/1967 | Thompson . | |
| 3,445,322 | 5/1969 | Salla et al. . | |
| 3,563,038 | 2/1971 | Healy et al. . | |
| 3,654,765 | 4/1972 | Healy et al. . | |
| 3,754,362 | 8/1973 | Daimler et al. . | |
| 4,045,964 | 9/1977 | Barclay . | |
| 4,622,138 | 11/1986 | Wager | 405/43 X |
| 4,745,716 | 5/1988 | Kuypers . | |
| 4,811,537 | 3/1989 | D'Epenoux . | |
| 4,943,185 | 7/1990 | McGuckin et al. | 52/169.14 X |
| 5,102,260 | 4/1992 | Horvath et al. | 52/169.5 X |
| 5,199,233 | 4/1993 | Fukutomi et al. | 52/169.14 |
| 5,263,792 | 11/1993 | Davies et al. | 52/169.5 X |
| 5,337,533 | 8/1994 | Kajita | 52/169.14 X |
| 5,346,565 | 9/1994 | White . | |
| 5,352,531 | 10/1994 | Roberts et al. . | |
| 5,511,346 | 4/1996 | Kenworthy . | |
| 5,518,799 | 5/1996 | Finestone et al. . | |
| 5,534,303 | 7/1996 | Roberts et al. . | |
| 5,534,583 | 7/1996 | Roberts et al. . | |
| 5,634,741 | 6/1997 | Tremblay et al. | 52/169.14 X |

FOREIGN PATENT DOCUMENTS

| | | | |
|---|---|---|---|
| 2925513 | 1/1981 | Germany | 52/169.14 |

OTHER PUBLICATIONS

"Envionmentally Friendly Basement Waterproofing" Rubber Polymer Corporation, Akron, Oh 44313.

*Primary Examiner*—Christopher Kent
*Assistant Examiner*—Timothy B. Kang
*Attorney, Agent, or Firm*—Andrus, Sceales, Starke & Sawall

[57] ABSTRACT

A water impervious, elastomeric coating is applied to the outer surface of a foundation wall and across the joint between the lower end of the wall and the footing. Protection board is bonded to the elastomeric coating and serves to prevent damage to the coating during backfilling of the foundation wall. The protection board is composed of an impact resistant, extruded, thermoplastic material and has inner and outer faces connected together by a series of parallel spaced ribs which define vertical channels that extend the height of the board. A plurality of spaced isolated holes are formed in the outer face of the board and communicate with the channels. The board not only protects the elastomeric coating from damage, but the inner face provides an additional waterproofing membrane, and the holes and channels facilitate movement of water to the drain tile and relieve hydrostatic pressure on the wall.

11 Claims, 4 Drawing Sheets

FOUNDATION WALL CONSTRUCTION

BACKGROUND OF THE INVENTION

Waterproofing coatings are frequently applied to the outer surface of concrete foundation walls to prevent water penetration through the wall. By definition, a "waterproofing" coating is one that will prevent the passage of water when the water present in the soil is under hydrostatic pressure. In contrast, a "damp-proofing" coating is one which is not intended to be impermeable when the water in the soil is under pressure. An extremely effective waterproofing coating is that described in U.S. Pat. No. 5,352,531. The coating of that patent is a highly adhesive, elastomeric type which is asphalt free and when cured is of nonhazardous and nontoxic. The coating, preferably applied to the foundation wall by spraying, provides an elastic, highly adhesive, water impervious membrane that firmly adheres to the foundation wall to prevent penetration of water through the wall even when the wall is subjected to substantial hydrostatic pressure, up to about 90 pounds per square foot, or more.

After application of the elastomeric coating to the foundation wall, the wall is backfilled normally through use of mechanical handling equipment, such as a bulldozer. It has been found that during backfilling, solid material such as coarse rocks and stones, scrap lumber, sheet metal, and other materials may be forced against the wall and may rupture the elastomeric coating, with the result that the water impermeable characteristics of the coating may be destroyed. Because of this, it is recommended to apply protection board over the elastomeric coating. The protection board is applied to the tacky coating and will firmly bond to the coating. The protection board as used in the past, is not in itself a waterproofing membrane. A common type of protection board as used in the past, is polystyrene foam board The polystyrene foam board aids in protecting the elastomeric coating and has some insulating value. However, the polystyrene foam is somewhat brittle and can be fractured by backfilling. Further, the polystyrene foam is not waterproof and over time will absorb water so that the protection board, in itself does not constitute a waterproofing membrane.

U.S. Pat. No. 5,511,346 describes a foundation wall construction utilizing a thermoplastic foam insulation and drainage board. In accordance with that patent, the outer surface of the foam insulation board is provided with a series of parallel flow channels each channel having a narrow inlet at the outer surface of the board and a wider portion in the interior of the board. The patent states that the channels aid in providing water drainage downward to the drain tile at the footing. However, with the construction as shown in U.S. Pat. No. 5,511,346, the channels cannot be placed too closely together without destroying the physical integrity of the foam board. If the channels are located too closely together, the thin area between channels is susceptible to damage and breakage during backfilling.

BRIEF SUMMARY OF THE INVENTION

The invention is directed to an improved, waterproofing system for a backfilled foundation wall. In accordance with a preferred form of the invention, the outer surface of the foundation wall, which can be constructed of poured solid concrete, hollow core block, or other building materials, is coated with a water impervious elastomeric coating such as that of the type described in U.S. Pat. No. 5,352,531. The highly adhesive elastomer coating is bonded firmly to the outer surface of the wall and extends over the entire wall surface up to the established grade, including the joint between the lower end of the wall and the footing.

Protection board is bonded to the elastomeric coating and serves to prevent damage to the coating, particularly during backfilling. In accordance with the invention, the protection board is preferably formed of extruded, thermoplastic material and includes an inner face, which is bonded to the elastomeric coating, and a parallel outer face. A plurality of spaced ribs interconnect the two faces and define a plurality of vertical flow channels which extend the entire height of the board. A plurality of holes are formed in the outer face of the board and provide communication with the channels.

In practice, the elastomeric coating is initially applied, preferably by spraying, to the outer surface of the foundation wall and across the joint between the wall and the footing. The protection board is then bonded to the highly adhesive-coating. The board will extend from the footing upwardly either to a location adjacent the established grade or to the sill plate. Vertical edges of adjacent boards can be in abutting relation and the vertical joint between boards can be covered with a waterproofing composition, tape, caulking or other sealing material. With the protection board in place over the desired outer surface of the foundation wall, the wall can then be backfilled when appropriate.

The extruded thermoplastic material is rigid and has a high impact strength, thus protecting the elastomeric membrane against rupture during backfilling.

As the protection board is impervious to water, the inner face of the board, which is bonded firmly to the elastomeric coating, provides an additional water impervious membrane to further aid in preventing water penetration through the wall. Because the inner face of the board provides an additional waterproofing membrane, the thickness of the elastomeric coating can be reduced.

The holes or openings in the outer face of the protection board which communicate with the channels facilitate movement of the water downwardly through the channels to the drain tile and also relieve hydraulic pressure against the wall. In one modified form of the invention, the outer face of the protection board may be covered with a thin layer of filtering material to help prevent blockage of the holes by soil particles. Most conveniently, the filtering material layer may be adhered to the outside face of the board with spaced adhesive strips or otherwise attached to avoid covering and filling an excessive number of holes.

As the protection board is preferably used as lightweight, 8 foot high sheets of varying widths, with the 8 foot dimension extending vertically, there are no horizontal seams in the protection board, which could cause a problem during backfilling. Backfilling may tend to rip horizontal seams and pull the protection board away from the wall. Preferably, the board is trimmed along the top edge just below the grade line defined by the backfilling.

The protection board as used in the invention, also provides a unique corner construction for inside or outside corners of the foundation wall, which eliminates tape joints at the corners. For example, with an outside wall corner, the outer face of the protection board is cut vertically in alignment with the corner and the board can then be bent around the corner. As the inside face maintains its integrity at the corner, there is no necessity for taping a corner joint as is necessary with conventional protection board.

In a modified form of the invention, a composite structure, consisting of insulation board with the extruded polymeric protection board bonded to the outer surface of the insulation board, is applied to the elastomeric coating on the foundation wall. The insulation board, which preferably takes the form of a polymeric foam material, adds insulation to the wall while the protection board serves to protect both the insulation board and the elastomeric coating from damage during backfilling.

Other objects and advantages will appear during the course of the following description.

DESCRIPTION OF THE DRAWINGS

The drawings illustrate the best mode presently contemplated of carrying out the invention.

In the drawings.

DETAILED DESCRIPTION OF THE INVENTION

Figure 1:
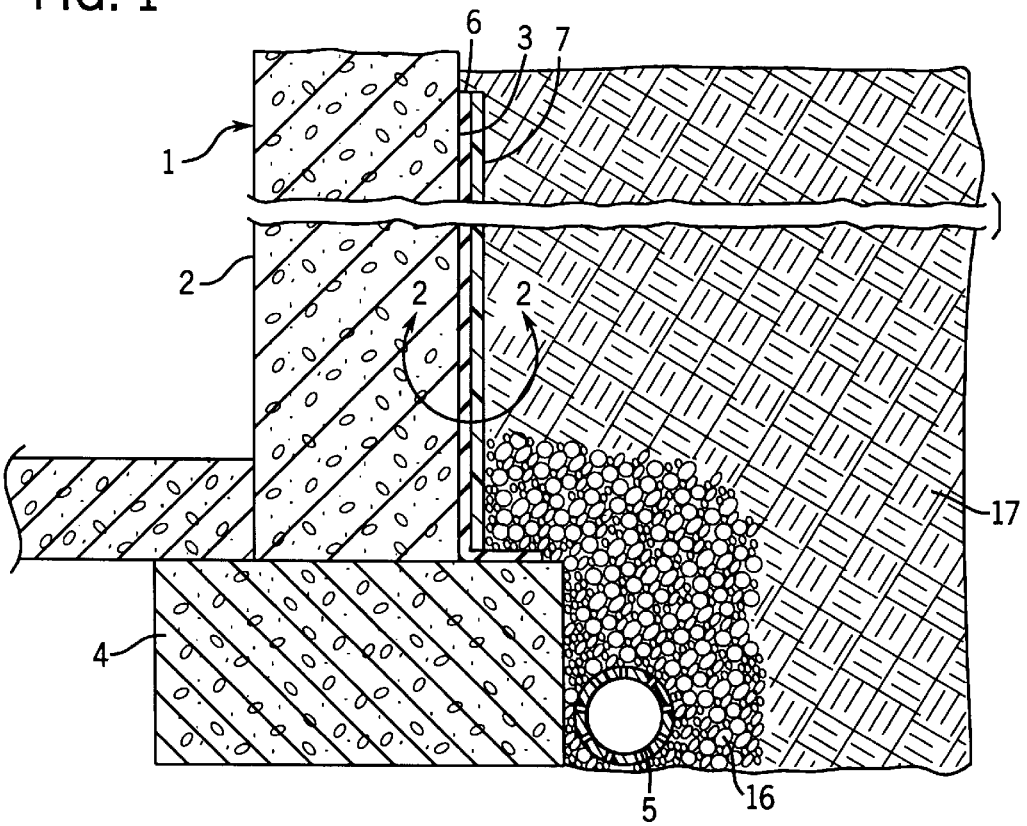
FIG. 1 is a vertical section of the waterproof wall construction of the invention.

As shown in FIG. 1, the wall construction includes a vertical foundation wall 1 which can be composed of cast-in-place concrete, concrete block, or expanded polymeric blocks filled with concrete. Wall 1 includes an inner surface 2 which faces inwardly of the building and an outer surface 3.

As shown in FIG. 1, the lower end of wall 1 rests on the central portion of a concrete footing 4, and as is customary, drain tile 5 is located outwardly of footing 4.

In accordance with a preferred form of the invention, an elastomeric coating 6 is applied to outer surface 3 of wall 1. Coating 6 extends from a location adjacent the final established grade, downwardly across the joint with the footing 4, and then over the upper surface of the footing, as shown in FIG. 1.

Coating 6 is a tough, elastic film which is impervious to water and provides a continuous membrane over the outer surface of the wall. Coating 6 can be formed of a composition as disclosed in U.S. Pat. No. 5,352,531, and consists of a block copolymer, a hydrocarbon resin and a solvent mixture consisting of toluene and petroleum distillate. Alternately, a water-base latex composition can be used to provide the impervious elastomeric coating.

Coating 6 is preferably applied over the outer surface 3 of wall 1 to the desired grade by spraying. Sheets of protection board 7 are then applied to the highly adhesive coating and firmly bonded to the coating. Sheets or boards 7 are preferably formed of an extruded thermoplastic resin, such as a polypropylene or polyethylene copolymer. For example, the polypropylene sheets have a notched Izod impact strength in foot pound/inch (ASTM-D256-A) at 70° F. of 3.5–6.6 and at −4° F., 1.0–0.8, a tensile strength (ASTM-D638 2 in/min) of 3700–4000 psi, a Rockwell hardness (ASMT-D785A) of 75–80, a water absorption after 24 hours (ASTM-D570) of 0.02% and a falling weight impact strength at −22° F. of 15 ft. lbs. The polypropylene sheets or boards 7 are generally inert, nontoxic and impervious to water.

Figure 2:
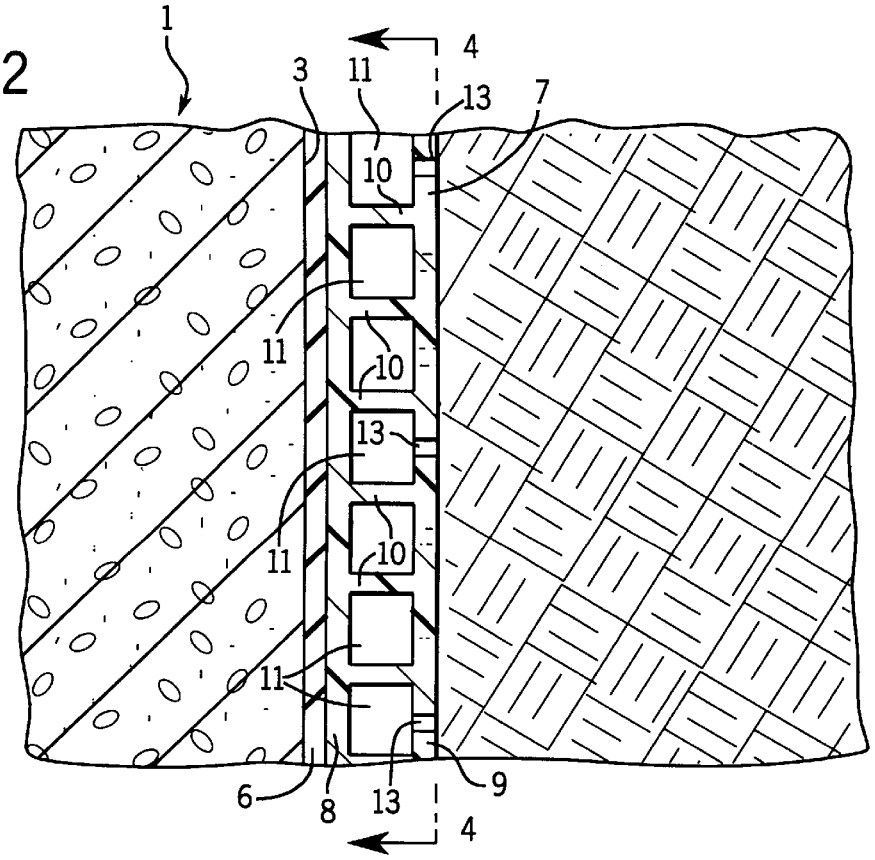
FIG. 2 is a horizontal section of the wall taken along line 2—2 of FIG. 1.

As best seen in FIG. 2, each sheet 7 includes an inner face 8 which is bonded to coating 6 and a parallel outer face 9. Faces 8 and 9 are connected by a series of spaced ribs 10 that extend vertically of wall 1 and define a plurality of parallel flow channels 11.

Boards 7 are employed as large sheets of varying width, with the long dimension extending vertically and the lower end of the sheet being supported on footing 4. Channels 11 at both ends of the sheet are open and the open upper ends of channels 11 can be closed off, if desired, by spraying on waterproofing composition, caulking, tape 12 or other material to prevent debris or foreign material from entering and possibly clogging the channels.

A plurality of holes or openings 13, which in practice can be about ¼ inch in diameter, are formed in outer face 9 and communicate with channels 11. The particular pattern of holes 13 is not critical, and in practice the holes can be spaced about ½ inch apart in all directions. It is not necessary that a hole communicate with each of the multiple channels 11. Holes 13 can be circular or elongated, or can have the desired configurations.

The vertical edges of adjacent panels or sheets 7 can be disposed in butting relation and if desired, waterproofing composition, caulking, tape or other sealant can be applied over the vertical joint.

Figure 3:
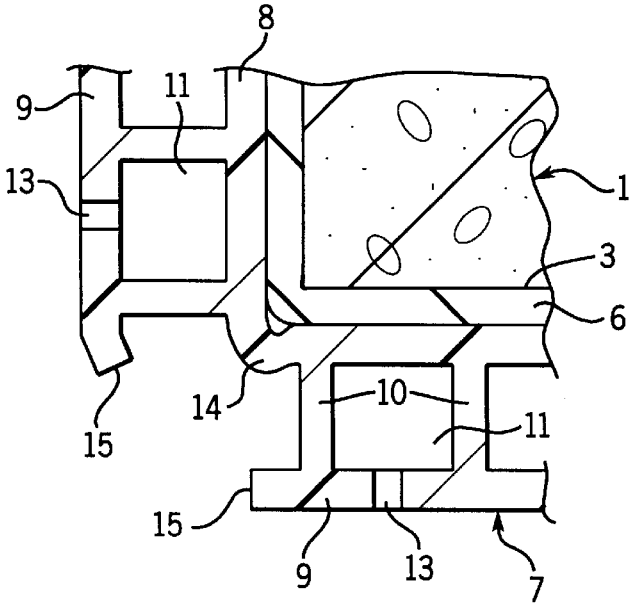
FIG. 3 is a horizontal section of an outside corner of the wall and showing the elastomeric coating and the protection board.
Figure 4:
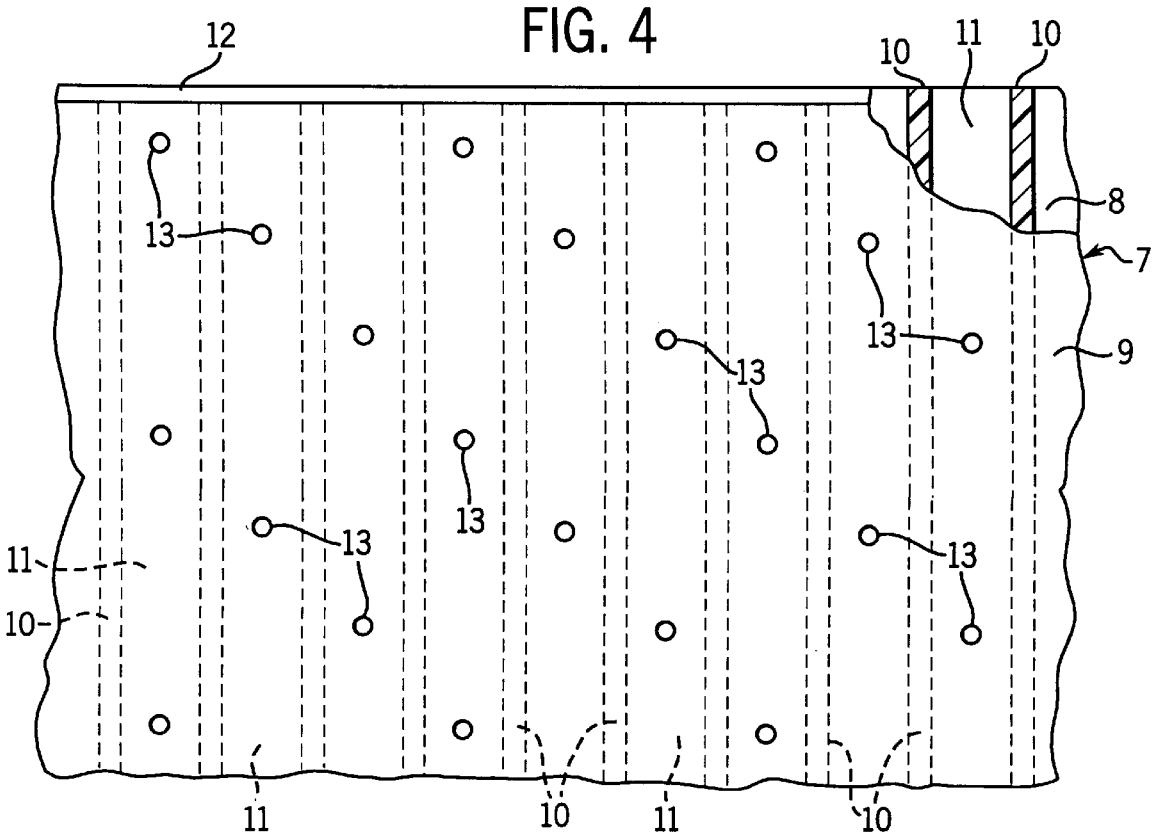
FIG. 4 is a section taken along line 4—4 of FIG. 2.

The protection board 7 as used in the invention, provides a unique manner of covering either inside or outside corners, which eliminates the use of tape or other sealant at the corner. As shown in FIG. 3, wall 1 is formed with an outside corner and outer face 9 is cut or severed along the entire vertical height of the board. The board is then bent to a general right angle configuration and bonded to the elastomeric coating 6 with the inner face 8 serving as a hinge as indicated by 14. The severed outer face is shown at 15. As inner face 8 is not severed, it forms a continuous secondary membrane over the coating 6, and no taping or sealing of the vertical corner area is required.

After protection board 7 has been applied to the desired outer surface 3 of wall 1, gravel backfill 16 is applied over drain tile 5 and the wall is then backfilled with soil, as indicated by 17, with the established grade of the backfill being slightly above the upper end of coating 6 and protection board 7.

The waterproofing system of the invention has distinct advantages. As the extruded thermoplastic protection board 7 is water impervious and will not absorb any appreciable amount of water, the inner face 8, which is bonded to the elastomeric coating 6, provides an additional waterproofing membrane which adds to the waterproofing characteristics of the construction. Due to the fact that inner face 8 also forms a water impervious membrane, the thickness of coating 6 can be reduced.

Holes 13 along with channels 11, facilitate movement of water downwardly through the channels to the drain tile. The multiple channels provide numerous pathways for the flow of water and serve to relieve hydraulic pressure on the wall and aid in keeping ground water away from coating 6 on wall 1.

As the protection board 7 has high impact strength and hardness, it serves to effectively protect the elastomeric coating 6 against rupture or damage during backfilling.

As the boards 7 are preferably in the form of large sheets that extend the vertical height of the wall, there are no horizontal seams which could be disrupted and opened during the backfilling operation.

Figure 5:
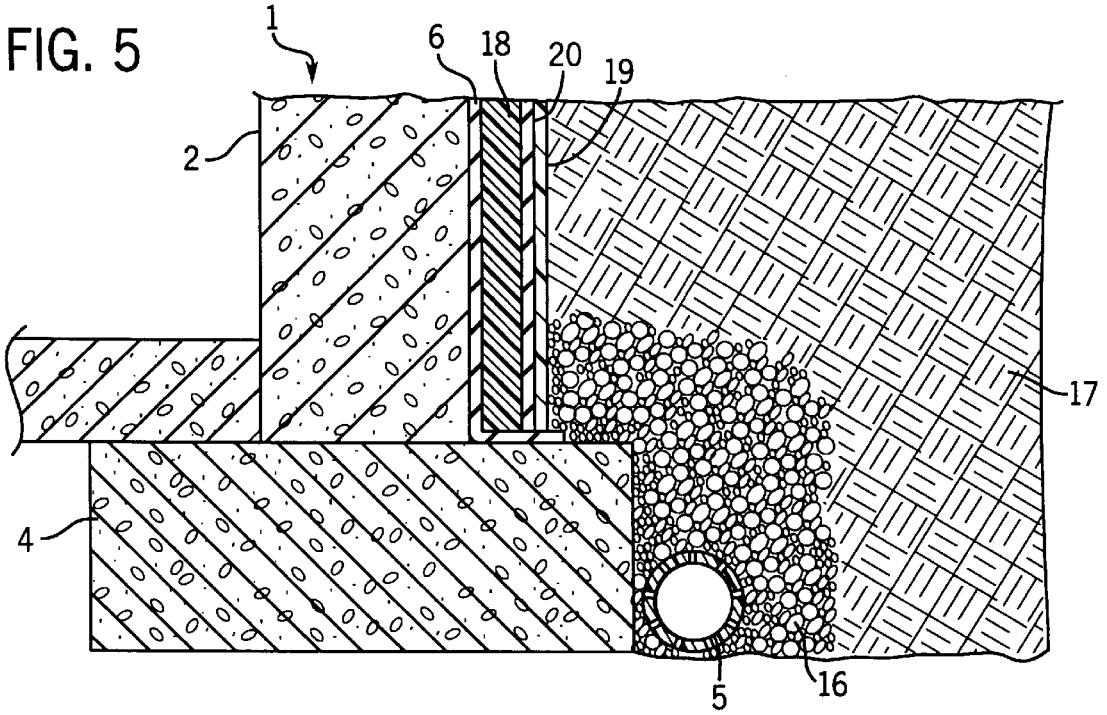
FIG. 5 is a vertical section of a modified form of the wall construction.
Figure 6:
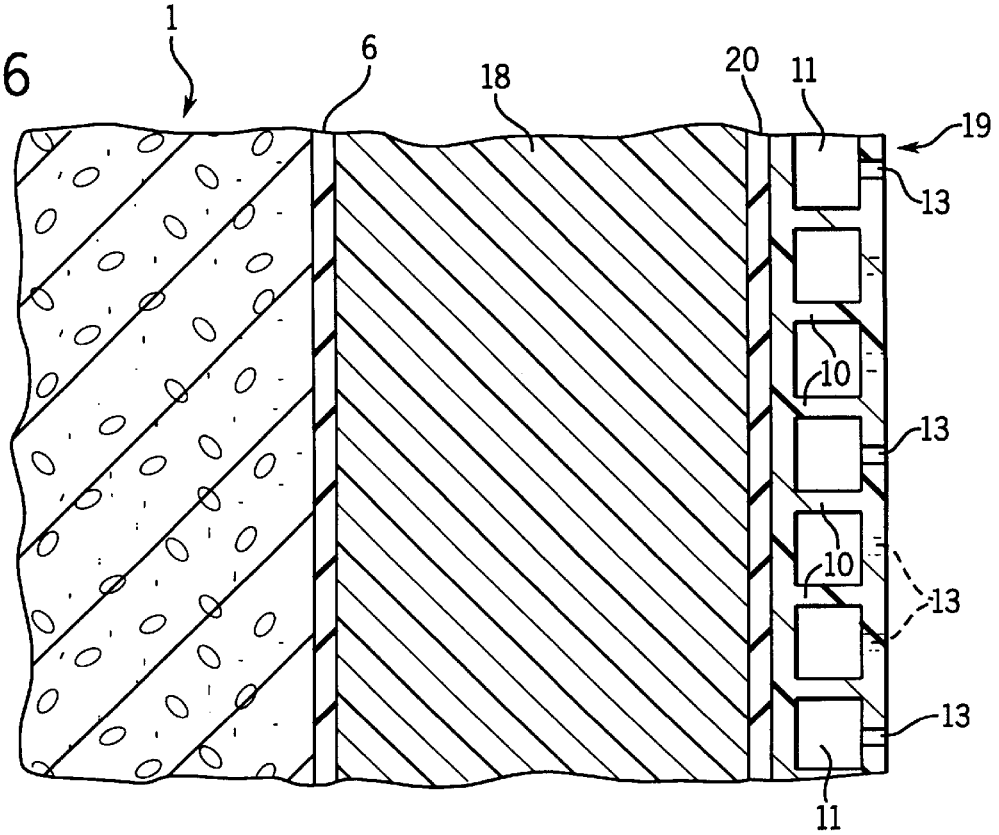
FIG. 6 is a fragmentary horizontal section of the wall construction of FIG. 5.

FIGS. 5 and 6 illustrate a modified form of the invention in which added insulation is incorporated with the protection board. In this embodiment, insulation board 18 is applied to the adhesive coating 6 while the coating is tacky. The insulation board 18 can be a rigid polymeric foam material such as polystyrene foam and is used in the form of large sheets that preferably extend the full height of the wall. Tape or other sealing material can be applied over the vertical joints between adjacent boards or panels 18.

Protection board 19, similar in construction to board 7, is bonded to the outer surface of insulation board 18 by a suitable adhesive layer 20. Adhesive layer 20 can be a solvent-base or water-base elastomeric composition such as that described in connection with coating 6 or it can be any other suitable adhesive. In practice, the insulation board 18 and the protection board 19 can be pre-fabricated as a composite structure and the composite structure is then applied to the wall 1 at the work site. Insulation board 18 provides added insulation for foundation wall 1, and protection board 19 serves to protect both insulation board 18 and coating 6 from damage during backfilling while providing ground water drainage.

Figure 7:
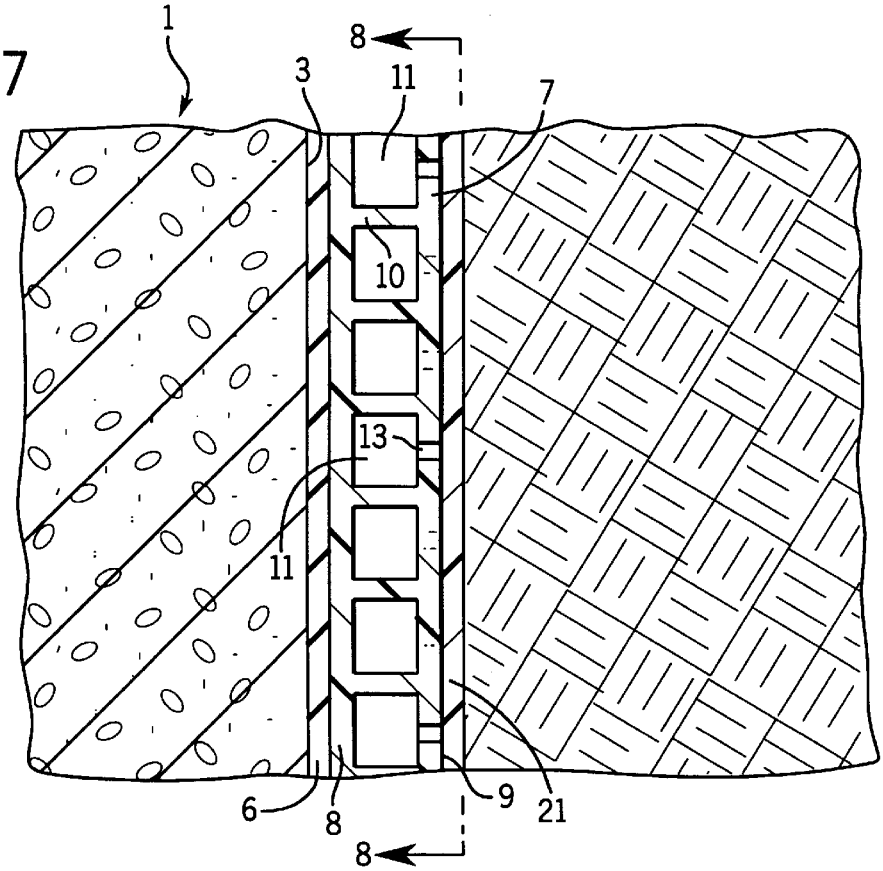
FIG. 7 is a horizontal section similar to FIG. 2 showing a further embodiment of the invention.
Figure 8:
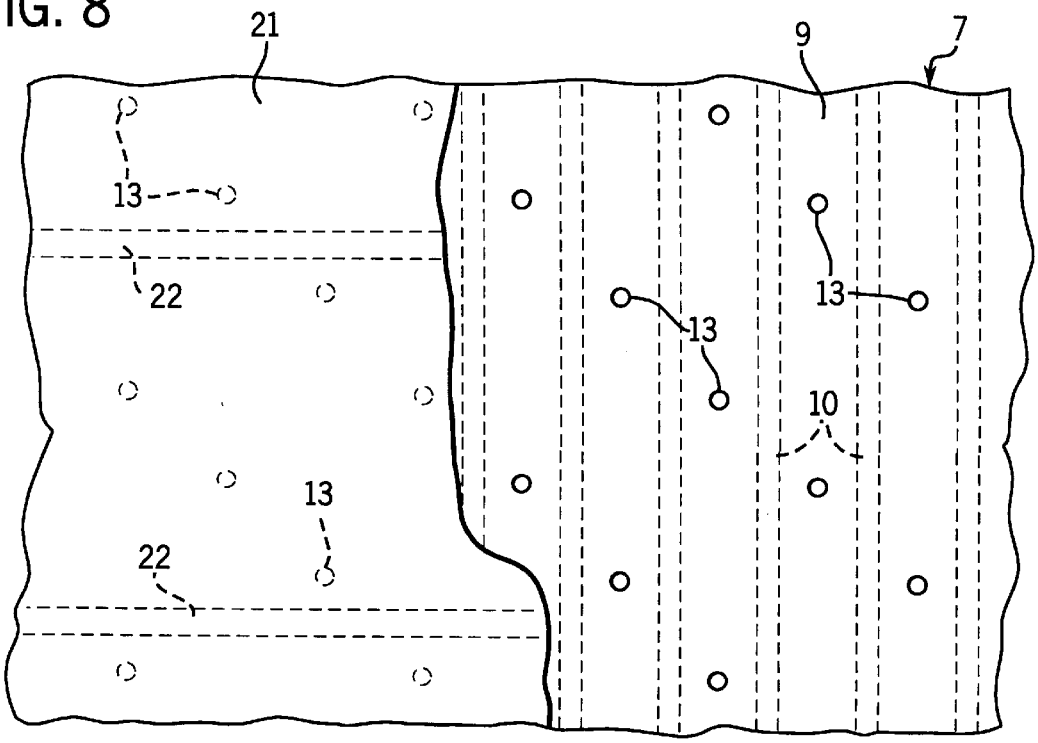
FIG. 8 is a section taken along line 8—8 of FIG. 7.

In a further embodiment of the invention, shown in FIGS. 7 and 8, the protection board 7 and the manner in which it is attached to the vertical wall 1 are the same as in the embodiment shown in FIGS. 1–4. The same reference numbers have been applied to the elements of this embodiment which are identical. In this embodiment, the outer face 9 of the boards 7 is covered with a thin layer of a filtering material 21 which helps prevent soil particles from blocking the openings 13 in the outer face of the board. The filtering material layer 21 may comprise a thin layer of open cell foam, such as polyurethane or polyethylene. The layer may have a thickness of, for example, about ⅛ inch, but this is not critical. The layer should simply permit free flow of water into the openings 13 in the boards, yet prevent soil particles or other materials from blocking the openings. The filter material layer 21 may be attached to the outer face 9 of the boards with narrow adhesive strips 22 which, as shown in FIG. 8, extend horizontally and are vertically spaced. By maintaining the adhesive strips 21 narrow in width and spacing them as far apart as possible while still retaining the layer of filter material 21 in position, very few openings 13 will be covered and plugged by the adhesive strips.

I claim:

1. A foundation construction, comprising a foundation wall having an inner surface and an outer surface, and a protection board disposed against the outer surface of said wall and composed of a rigid plastic material, said protection board including an inner face facing toward the outer surface of said wall, and a generally parallel outer face, said board also including a plurality of spaced vertical ribs connecting the inner face and the outer face each of said vertical ribs and extending the entire height of the board, said ribs defining a plurality of spaced vertical drainage channels, said inner face and said outer face and said ribs being an integral monolithic structure, said outer face including a plurality of holes providing communication between said channels and the exterior.

2. The construction of claim 1, and including bonding means for bonding said protection board to said outer surface.

3. The foundation construction of claim 2, and including earth backfill disposed in contact with said outer face.

4. The foundation construction of claim 1, wherein said protection board is an extruded thermoplastic material.

5. The foundation construction of claim 1, wherein at least one of said holes communicates with each channel.

6. The foundation construction of claim 1, and including a water impervious elastomeric coating disposed on the outer surface of said foundation wall and extending substantially continuously over the entire area of said outer surface, said protection board being bonded to said elastomeric coating, and a footing to support said foundation wall, said elastomeric coating extending across the joint between said footing and said wall.

7. A foundation construction, comprising a footing, a foundation wall supported on said footing and having an inner surface and an outer surface, a water impervious elastomeric coating disposed on said outer surface and extending continuously from a location near an upper portion of said wall to a lower end of said wall and extending across the joint between said wall and said footing, a protection board bonded to the elastomeric coating and composed of a rigid plastic material, said protection board including an inner face bonded to the elastomeric coating and an outer face disposed parallel to said inner face, said protection board also including a plurality of spaced vertical ribs connecting said faces and each of said vertical ribs extending the entire height of the board, said ribs defining a plurality of spaced vertical channels, said inner face and said outer face and said ribs being an integral monolithic structure, said outer face having a plurality of spaced isolated holes providing communication with said channels, and earth backfill disposed in contact with said outer face.

8. The foundation construction of claim 7, wherein each channel has an open upper end and an open lower end disposed adjacent said footing, said construction also including closure means for closing the open upper end of each channel.

9. A foundation wall construction, comprising a first wall section, a second wall section joined to said first wall section at a corner, said wall sections each having an outer surface, a protection board disposed against the outer surfaces of the wall sections, said protection board including a sheet-like first face and a generally parallel sheet-like second face, said protection board also including a plurality of vertical ribs connecting said faces and each of said vertical ribs extending the entire height of the board, said ribs defining spaced vertical channels that extend the entire height of said board, said first face and said second face and said ribs being an integral monolithic structure, said first face being severed along a selected channel to provide said first face with a pair of severed edges that extend the entire height of said board, said board being bent along said selected channel to conform to the contour of said wall sections at said corner and said second face being bonded to the outer surfaces of said wall sections, said first face having a plurality of holes providing communication with said channels.

10. The foundation construction of claim 9, and including a layer of water impervious elastomeric material disposed on the outer surface of each wall section and bonded to said second face of said board, said elastomeric material providing a water impervious first membrane preventing penetration of water through said wall sections and said second face providing a water impervious second membrane.

11. The foundation construction of claim 9 and including a footing to support said wall sections, said elastomeric material extending across the joint between said wall sections and said footing, said channels each having an open lower end disposed adjacent said footing, and earth backfilling disposed in contact with the first face of said protection board.

* * * * *